United States Patent [19]

Barroyer et al.

[11] Patent Number: 4,825,940

[45] Date of Patent: May 2, 1989

[54] AUTOMATIC PROCESS AND DEVICE FOR CLEANING A HEAT EXCHANGER FOR GASEOUS FLUIDS

[75] Inventors: Paul Barroyer, Villeneuve d'Asq; Eric Piat, Lille; Bernard Foucher, Chereng-Gruson; Leon Bouilliez, Marcq-en-Baroeul, all of France

[73] Assignee: Etablissements Neu, Lille, France

[21] Appl. No.: 922,903

[22] Filed: Oct. 24, 1986

[30] Foreign Application Priority Data

Oct. 25, 1985 [FR] France ..... 85 15923

[51] Int. Cl.[4] ..... F28G 7/00

[52] U.S. Cl. ..... 165/84; 165/95; 122/379; 15/104.05; 15/316 R; 15/316 A

[58] Field of Search ..... 165/84, 94, 95; 122/390, 391, 379; 15/104.05, 316 R, 316 A

[56] References Cited

U.S. PATENT DOCUMENTS

| | | | |
|---|---|---|---|
| 2,795,400 | 6/1957 | Stark . | |
| 3,288,204 | 11/1966 | Grames et al. . | |
| 3,364,983 | 1/1968 | Krinov et al. | 165/84 |
| 4,366,003 | 12/1982 | Korte et al. | 165/95 |
| 4,583,585 | 4/1986 | Estienne et al. | 165/94 |

FOREIGN PATENT DOCUMENTS

| | | | |
|---|---|---|---|
| 1248787 | 11/1960 | France . | |
| 285009 | 7/1970 | U.S.S.R. | 165/84 |
| 996841 | 2/1983 | U.S.S.R. | 165/95 |
| 1143964 | 3/1985 | U.S.S.R. | 165/84 |
| 1112964 | 5/1968 | United Kingdom . | |

*Primary Examiner*—Albert W. Davis, Jr.

*Attorney, Agent, or Firm*—Armstrong, Nikaido, Marmelstein, Kubovcik & Murray

[57] ABSTRACT

Automatic device for regular cleaning of the surfaces of a heat exchanger for gaseous fluids flowing in vertical channels (1) defined between the said surfaces, comprising resilient members (5) arranged permanently in the said channels (1) and capable of being caused to vibrate in order to perform the cleaning of the said surfaces, characterized in that it comprises conduits (10, 11, 12) for the injection of additional compressed gas, opening out in front of the openings of groups of channels (1) and an injection control device designed to produce, successively and at regular intervals for each group of channels, an injection of additional compressed gas inducing in the said group of channels (1) a flow of gaseous fluid originating from the exchanger, causing the resilient members (5) present in each group of channels (1) to vibrate.

13 Claims, 3 Drawing Sheets

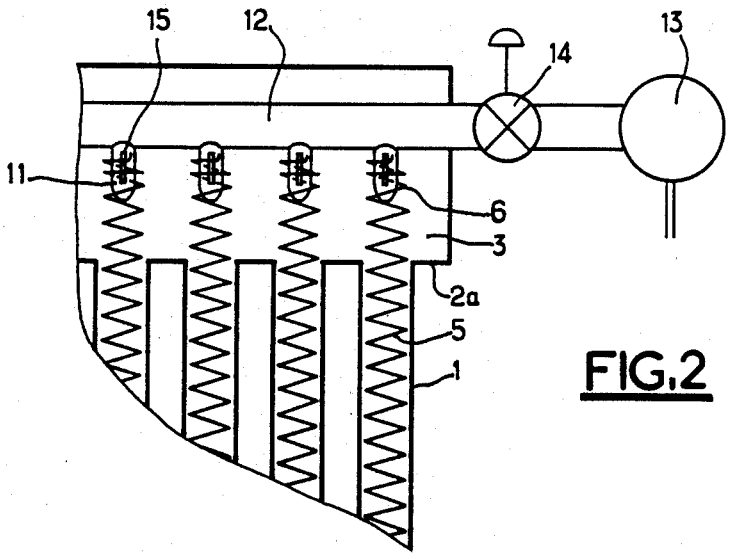
FIG.2
FIG.3
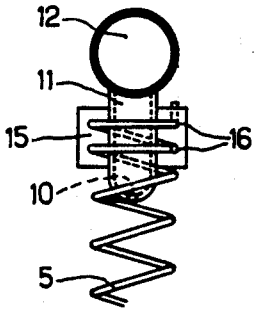
FIG.4
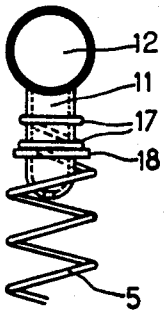

AUTOMATIC PROCESS AND DEVICE FOR CLEANING A HEAT EXCHANGER FOR GASEOUS FLUIDS

The present invention relates to an automatic process and device for regular cleaning of the surfaces of a heat exchanger intended to treat gaseous fluids flowing in vertical channels defined between the said surfaces.

The problem posed by the fouling of the exchange surfaces of heat exchangers constitutes a major obstacle in their utilization. In the case of heat exchangers intended to treat gaseous fluids, a reduction in the exchanged heat flow is first observed, owing to the fouling of the walls between which the gaseous fluid is flowing. Furthermore, dust deposits are found, and these may quickly grow to considerable thicknesses, giving rise to an appreciable increase in the pressure drops.

Since, in general, heat exchangers consist of a number of parallel channels, the fouling entails a risk of blocking of a part of the gas flow cross-section, and this is reflected in a loss of exchange surface, leading to a decrease in the exchanger efficiency. It is very difficult, in fact, to ensure a strictly uniform distribution of the flows in all the parallel channels of a heat exchanger of this kind. Thus, it is conceivable that a number of channels receive less flow than others. Since, in general, all the channels are geometrically identical, the flow velocities in some channels may thus be lower than in others. Since the rate of deposition of dust particles varies inversely with the flow velocity of the gases, this results in a preferential deposition of the solid particles along the walls of the regions of the exchanger which are less well supplied. The pressure drop characteristics of the obstructed channels quickly increase with the reduction in their hydraulic diameter, and this once more results in a decrease in the flow velocities. Thus, the phenomenon sustains itself and is even self-accelerating until certain channels become completely blocked.

In general, to avoid these disadvantages, regular maintenance of the exchange surfaces is carried out. This maintenance may be carried out noncontinuously, with human intervention at regular intervals. However, a process of this kind has the disadvantage of involving high labour costs, together with losses of output as a result of the plant stoppages required.

Consideration has therefore been given to combating the fouling of heat exchangers by acting on the actual source of the phenomenon. The initial idea was to combat the blocking of heat exchangers by organizing the flows in a strictly uniform manner so that the solid deposits are produced simultaneously on all the surfaces. The thickness of the deposits then tends asymptotically towards a limit at which the rate of erosion counterbalances the rate of deposition. Such a stable limit to the thickness of the deposits avoids the partial blocking of the gas flow cross-section in the exchanger. French Patent No. 2,524,132 describes an implementation of this kind, in which the flow of the gases is organized in a perfectly uniform manner. It is impossible, however, to rule out an accidental imbalance in the feed, which would then cause blocking to commence.

Another way of combating fouling and blocking is to provide for the inside Of the tubes to be cleaned. Devices for this purpose have been provided, especially for tubular heat exchangers intended for the treatment of liquids.

It is known, for example, to use supple bodies which are slightly greater in size than the diameter of the tubes, and which are forced over their entire length by hydraulic pressure (see European Patent No. 41,698). However, a process of this kind cannot be applied in the case of a compressible gas flow.

The use of constraints on the friction of the fluids-on the exchange walls, and their abrupt variation have been recommended in some cases to loosen the particulate deposits. For example, a device for cleaning boiler flue pipes using steam or compressed air is known (see European Patent No. 29,933). However, not all solid deposits can be loosened under the influence of the friction constraints by themselves, and only a mechanical scraping could guarantee a regular maintenance of the exchange surfaces.

In the case of heat exchangers which are intended for treating liquids, the use of a resilient metal spiral which is agitated by the liquid flow (French Patent No. 2,479,964) has already been envisaged. In a process of this kind, the amount of movement transmitted by the liquid is sufficient to cause the agitation of the metal wire which repeatedly comes into contact with the inner walls of the tubes, performing the cleaning in this manner. However, in the case of a gaseous fluid, such a process could not be employed, since the amounts of movement which are transmitted by the gases are not sufficient under normal conditions of use. An increase in the flow velocity of the gaseous fluid, in order to obtain the desired effect, would result in the appearance of much too high pressure drops.

French Patent No. 2,435,292 also adapted to the case of a heat exchanger for treating liquids, makes use of a mechanical device for regularly withdrawing a helicoidal spring whose function is to scrape off the materials deposited along the walls, thus preventing their being damaged through local overheating. The use of a tight fit along the tube wall is recommended.

The use of a mechanical device of this kind for a heat exchanger intended to treat gaseous fluids, especially at a high temperature which may exceed 800° C., which are dusty and possibly corrosive, would present considerable difficulties both from the standpoint of the design and of reliability.

The subject of the present invention is a process and a device, both automatic, for regular cleaning of the inner surfaces of a heat exchanger for gaseous fluids, which makes it possible to produce a vibration of resilient scraping members placed inside the channels of the heat exchanger, this being done by simple, pneumatically actuated means, in order to solve the problems posed by the adaptation of the known cleaning devices to the heat exchangers intended to treat gaseous fluids.

According to the invention, the automatic process for regular cleaning of the surfaces of a heat exchanger for gaseous fluids flowing in vertical channels between the said surfaces, makes use of resilient members which are permanently arranged in the said channels and are capable of being caused to vibrate in order to perform the cleaning of the said surfaces. The resilient members are caused to vibrate, according to the invention, in succession, in the case of at least one group of channels of the heat exchanger, by means of an injection of an additional compressed gas in a position such that it induces in the said group of channels a flow of gaseous fluid originating from the exchanger.

The injection of the additional gas may be manually controlled intermittently, or according to a sequence which is determined for of each group of channels of the exchanger controlled by an automatic pilot system.

The injection of additional gas under pressure may be performed along the axis or in the plane of symmetry of the channels, or alternatively in an inclined manner, depending on the applications.

The injection of compressed additional gas is preferably performed by means of nozzles positioned upstream of the mouth of each channel of the heat exchanger.

Another subject of the invention is an automatic device for regular cleaning of the surfaces of a heat exchanger for gaseous fluids, which enables the process of the invention to be implemented. The device of the invention comprises conduits for the injection of additional compressed gas which open out upstream, in front of the openings of the groups of channels and an injection control device designed to produce, successively and at regular intervals for each group of channels, an injection of additional compressed gas inducing into the group of channels a flow of gaseous fluid originating from the exchanger, thus causing the resilient members present in the group of channels to vibrate. These vibrations, which take place lengthwise, transversely and rotationally at the same time, give rise to a multitude of contacts between the resilient members and the inner walls of the channels of the heat exchanger, thus resulting in a scraping of these walls and a loosening of the solid particles which can then fall into the vertical channels under the action of gravity and/or can be entrained by the gas flow.

The resilient members are preferably fastened at both their ends in the vicinity of the two ends of the channels.

In an alternative form, the resilient members may be fastened only at their high end, in the vicinity of the opening, the low end of the resilient members being then free.

The injection conduits preferably comprise injection nozzles which direct the flow of additional compressed gas towards the upper opening of the channels. These nozzles may additionally be used to fasten the upper part of the resilient members, either directly, or via additional members forming an integral part of the nozzels or fastened to the nozzles.

The resilient members are arranged in the vertical channels of the heat exchanger in the immediate vicinity of their inner walls, but without coming into contact with the said walls during the normal operation of the exchanger, that is to say outside the cleaning periods.

In the course of the normal operation of the exchanger, the resilient members thus act as turbulence-generators which disturb the boundary layer in the vicinity of the inner walls of the channels, and this enables the gas flow to be circulated at a low velocity which is preferably between approximately 8 and 12 m/second, and more particularly between approximately 8 and 10 m/second.

In a preferred embodiment, the resilient members consist of helically-wound metal wires. In an alternative form, use may be made of metal wires provided with a plurality of blades extending radially and advantageously profiled aerodynamically, so as to cause the resilient member assembly to vibrate due to the action of the gas flow induced by the additional compressed gas originating from the injection conduits.

The invention will be better understood from the study of the detailed description of some embodiments, which are taken by way of examples without implying any limitation, and illustrated by the attached drawings, in which:

FIG. 2 is a partial sectional side view of the exchanger of FIG. 1;

FIGS. 3 and 4 illustrate two alternative ways of fastening the top part of the resilient members;

Figure 1:
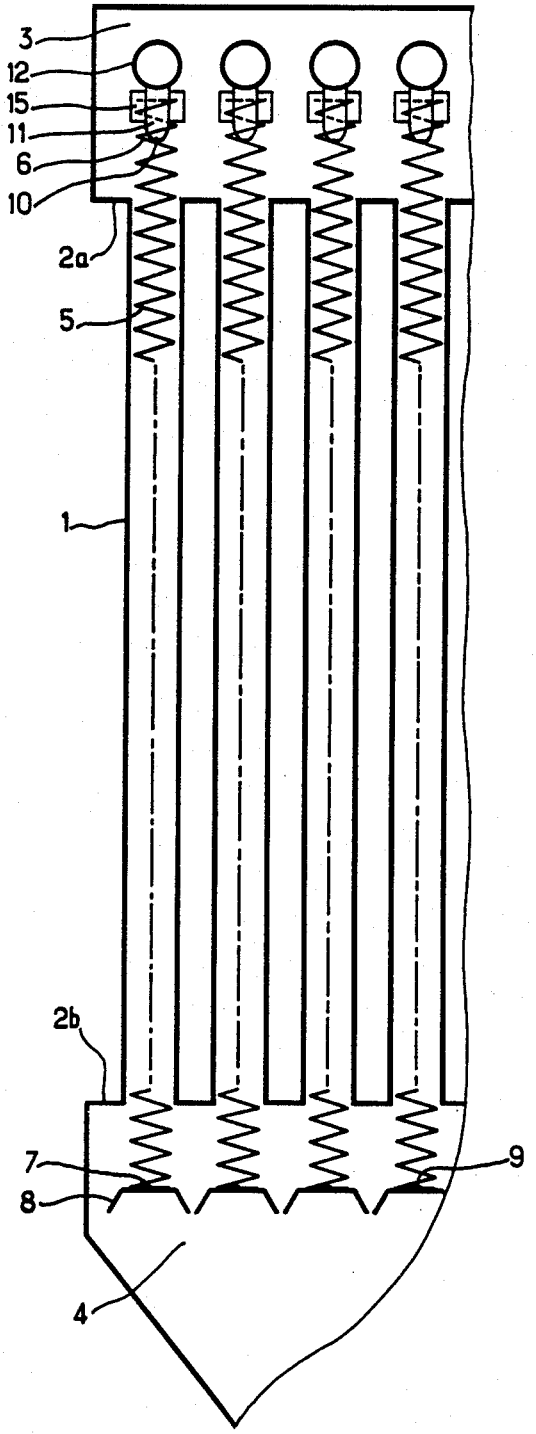
FIG. 1 is a partial sectional elevation view of a tubular heat exchanger comprising an automatic device for regular cleaning according to the invention.

As illustrated in FIGS. 1 and 2, the heat exchanger is of the cross-flow tubular type, in which the hot and dusty gases flow inside vertical tubes 1, preferably from the top downwards. The cooling air flows transversely to the direction of the hot and dusty gases, outside the tubes 1 and between them. It will be understood, of course, that the invention could equally apply, without major modifications, to an exchanger of the type comprising tubes and a calandria, with the cooling gases flowing parallel to the tubes, or alternatively to another type, especially to a plate heat exchanger.

The tubes 1 are fastened to the upper 2*a* and lower 2*b* end plates, by welding according to a method which is conventional in the construction of exchangers of this type. The tubes 1 are thus in communication with an upper plenum chamber 3 which serves to admit or extract the hot and dusty gases through an admission or extraction orifice which is not shown in the figures, and with a lower plenum chamber 4 comprising an extraction or admission orifice, also not shown. The lower plenum chamber 4 is preferably, as illustrated in FIG. 1, :n the shape of a hopper which makes it easier to recover the solid particles which will settle in it during the cleaning operations.

The sizing of the gas flow cross-sections is chosen so that a flow velocity of between approximately 8 and 12 m/second, and preferably approximately 8 and 10 m/second is obtained. It is appropriate, in fact, not to adopt a flow velocity which is too high, so as not to produce excessive pressure drops. On the other hand, a flow velocity which is too low would give rise to an overcrowding which would be unacceptable for the whole apparatus. The choice of the tube diameter is made so as to enable the gases to flow at the appropriate flow velocity, just mentioned, while permitting the resilient cleaning members to be inserted.

In the example illustrated in FIGS. 1 and 2, the resilient members consist of a helically-wound metal wire 5, forming a spring. The springs 5 are rigidly fastened at their high 6 and low 7 ends, both of which extend beyond the high and low ends of the tubes 1. The lower ends 7 of the springs 5 are fastened to a grid 8, itself rigidly mounted, by means which are not illustrated in the figures, in the lower plenum chamber 4. In the example illustrated, the grid 8 has a mesh which is identical to that of the axes of the exchanger tubes 1. It will be understood, however, that a different fastening could be envisaged perfectly well.

The fastening of the low part 7 of the spring 5 is performed by means of hooks 9 which permit ready dismantling. In this instance, too other means could be used, especially a fastening technique using nuts or pins, so long as easy dismantling remains possible.

Arranged in the high part of the heat exchanger and inside the upper plenum chamber 3 there is a plurality of injection nozzles 10 for an additional compressed gas which may, for example, be compressed air or steam under pressure. The nozzles 10 have ends of a small diameter which may, for example, be between 4 and 10 mm, approximately, it being understood that the choice of the diameter of the injection nozzle depends on the diameter of the exchanger tubes 1.

The nozzles 10 are centred on the axes of the tubes 1 and are placed at some distance above the opening of the tubes 1. In an alternative form, it would be possible for the axis of the nozzles 10 to have a certain slope relative to the axis of the tubes 1, and this would then enable the jet of compressed additional gas to be directed towards the periphery of the resilient members 5, producing a different excitation.

The injection nozzles 10 are connected by small vertical tubes 11 to an injection conduit 12, itself connected to a compressed gas storage vessel 13. It will be noted that, in the example illustrated, each injection conduit 12, equipped with its plurality of vertical tubes 11 and injection nozzles 10, allows gas to be injected into a row of tubes 1 (FIG. 2).

A control valve 14, which may be actuated manually or by means of a relay valve piloted by an automatic system, permits the controlled injection at regular intervals of the additional compressed gas held in the storage vessel 13, in the case of this row of tubes 1.

The upper end 6 of the springs 5 may be fastened directly to the vertical tubes 11. If reference is made to FIG. 3, this shows a first embodiment of a fastening of this kind. According to this embodiment, the injection tube 11 is equipped with lengthwise fins 15 which have perforations 16 enabling the upper end of the spring 5 to be passed through and wound on. FIG. 4 shows an alternative embodiment, in which the spring 5 terminates in a winding 17 which is smaller in diameter than the spring 5, the winding 17 being threaded onto the end of the injection tube 11 and locked with a clamping device 18. It will be noted, of course, that it would be perfectly possible to fasten the upper ends of the springs 5 by other means, for example directly on the injection conduit 12, or alternatively to a separate support mounted rigidly in the upper plenum chamber 3.

The device of the invention operates as follows. To carry out regular cleaning of the inner walls of the tubes 1, additional compressed gas at a pressure of the order of 2 to 6 bars is injected into a row of tubes 1 via the nozzles 10. This injection, which takes place for a relatively short time, for example between 1/10th of a second and a few seconds, induces momentarily a flow of gaseous fluid originating from the upper plenum chamber 3 and the tubes 1 of the neighbouring rows. This induced flow of gaseous fluid is of the order of four to six times the flow of additional compressed gas injected by the nozzles 10. The flow velocity produced in this manner inside the tubes 1, is thus very high. The amount of movement supplied in this way is imparted to the springs 5 and the agitation resulting therefrom is damped in the flow and along the walls of the tubes 1 by impacts and scraping, and this leads to the cleaning and maintenance of the quality of the internal surfaces of the heat exchanger tubes 1.

It is thus possible to prevent the fouling of the exchanger tubes without giving rise to excessive pressure drops, since the flow velocity, in normal operation out outside the cleaning periods, can be chosen to have a relatively low value, as already mentioned. Furthermore, the heat exchange performance is improved by virtue of the insertion inside the tubes of the springs 5 which act as turbulence-generators whose action of eliminating the boundary layers compensates for the decrease in the flow velocity. The use of a manual or automatic control system enables the frequency of injection of the additional compressed gas to be perfectly controlled and the wear and the frequency of replacement of the resilient members consisting of the springs 5 to be thus optimized.

Figure 5:
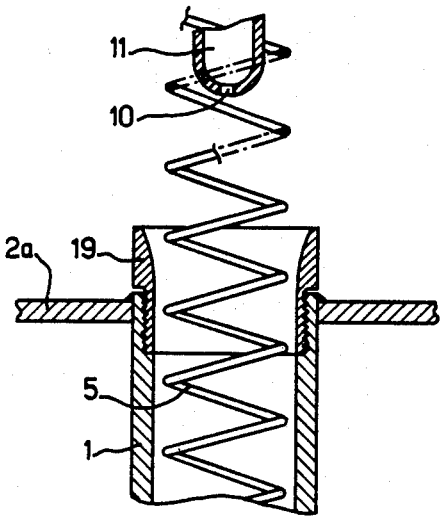
FIG. 5 illustrates diagrammatically and sectionally on an enlarged scale an alternative form of producing the top end of a heat exchanger tube.

FIG. 5 illustrates an alternative form of the device-of the invention, in which the upper end of each exchanger tube 1 is equipped with a mouthpiece 19 which partly enters the inside of the tube 1. The mouthpiece 19 may be fastened to the tube 1 by threading, as illustrated in FIG. 5, or by any other means such as clipping, welding, bonding, and the like. The mouthpiece 19 is given a profile in the manner of a convergent nozzle, so as to induce a higher flow of gaseous fluid under the effect of the injection of additional compressed gas by the nozzles 10 which are placed, as before, at some distance from the mouth of the tubes 1. The flow of the additional compressed gas required for the regular cleaning operation can thus be reduced further.

Figure 6:
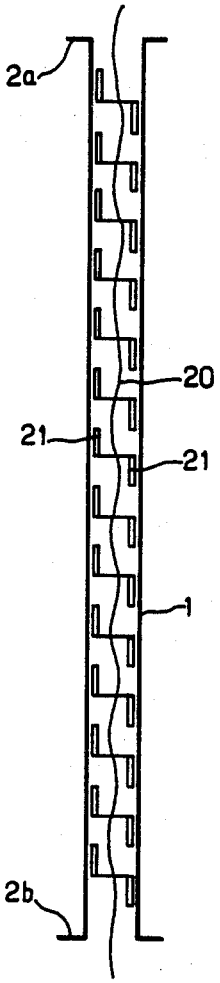
FIG. 6 illustrates diagrammatically, in section, an alternative form of resilient member which can be used to implement the present invention.

FIG. 6 shows diagrammatically a resilient member of a different structure, which can be used within the scope of the invention. This figure shows a tube 1, inside which the resilient member consists of a cable 20 which has gentle undulations and is equipped with a plurality of blades 21 extending radially and having an aerodynamic profile so as to be capable of being driven in a swirling manner in the gas flow parallel to the axis of the tube 1. The blades 21 then cause the cleaning by means of impacts and scraping, as before.

In all the cases, it will be noted that it is important that the resilient member consisting of the spring 5 or of the cable 20 equipped with the fins 21, or alternatively of any other equivalent means, should be placed inside the tube 1 or inside the vertical channel of the exchanger, so as to be in the immediate vicinity of its inner walls, without, however, coming into contact with the said walls during normal operation of the heat exchanger outside the cleaning periods. As a result of this, the boundary layer is actually perturbed by the parts of the resilient member which are in the vicinity of the inner walls of the tubes 1 and the cleaning is ensured more effectively during the injection of compressed gas.

In the examples which are illustrated, the resilient members have been fastened rigidly at their upper and lower ends. It will be understood, however, that it would be possible to envisage, in an alternative form, not to fasten the lower ends of the resilient members. The latter then remain unimpeded in the vicinity of their lower end 7 and can, in a manner of speaking, float in the gas flow. The vibration characteristics to which the injection of additional compressed gas and the induced gas flow give rise are then different and may be adapted to some particular blocking problems.

We claim:

1. A process for regularly cleaning internal surfaces of an array of vertical channels arranged for heat exchange between a flow of gaseous fluid flowing within said channels and another fluid flowing outside said channels, the upper opened end of each said channel communicating with an upper chamber and having a resilient member mounted permanently within each of said channels and extending along the channel length so as to be located in the gas flow near abut out of contact with said internal surfaces during normal heat exchange operation; the steps comprising injecting additional compresses gas into the upper ends of predetermined ones of said channels successively and at determined time intervals for different groups of said channels capable of causing said resilient members in predetermined ones of said channels to vibrate and contact the inner surfaces of said predetermined ones of said channels at a multitude of locations whereby any dust deposits or the like on said inner surfaces are scraped, loosened and removed from said inner surfaces.

2. Automatic process according to claim 1, characterized in that the injection of additional gas is controlled manually intermittently.

3. Process according to claim 1, characterized in that the injection of additional gas is controlled in a sequence determined for each group of channels of the exchanger by an automatic pilot system.

4. Process according to claim 1 characterized in that said injection of additional gas is performed by means of nozzles positioned upstream of the opening of each channel.

5. Process according to any one of claims 1, 2, 3 or 4 characterized in that said injection of additional gas is performed along the axis or in the plane of symmetry of the channels.

6. Process according to any one of claims 1, 2, 3 or 4 characterized in that said injection of additional gas is performed in a manner inclined relative to the axis or the plane of symmetry of the channels.

7. A device for periodically cleaning internal surfaces of an array of vertical channels arranged for heat exchange between a flow of gaseous fluid flowing within said channels and another fluid flowing outside said channels, the upper opened end of each said channel communicating with an upper chamber, comprising a resilient member mounted permanently within each of said channels along the channel length so as to be located in the gas flow near but out of contact with said internal surfaces during normal heat exchange operation; injection conduit means located in said upper chamber in registry with said opened end of at least some of said channels; and injection control means for producing an injection of compressed gas in a determined group of injection conduit means at determined time intervals into a corresponding determined group of said some channels for inducing into said corresponding channels a flow of gaseous fluid and causing said resilient member in said channel to vibrate and contact the inner surfaces of said corresponding channels at a multitude of locations therealong and scrap and loosen any deposits on said inner surfaces.

8. A device according to claim 7, characterized in that said resilient members are fastened at least at their high end close to the upstream opening of said channels.

9. A device according to any one of claims 7 or 8, characterized in that said resilient members are fastened at their opposite ends in the vicinity of the opposite ends of said channels.

10. A device according to any one of claims 7 or 8, characterized in that said injection conduits comprise injection nozzles directing the flow of additional compressed gas towards the upper opening of said channels.

11. A device according to claim 10, characterized in that the resilient members are fastened to the said nozzles.

12. A device according to claim 11, characterized in that said resilient members consist of helically-wound metal wires.

13. A device according to claim 11, characterized in that said resilient members consist of metal wires equipped with a plurality of radially extending blades.

* * * * *